US009375956B2

(12) United States Patent
Kato

(10) Patent No.: US 9,375,956 B2
(45) Date of Patent: Jun. 28, 2016

(54) RECORDING DEVICE, CONVEYANCE DEVICE, AND CONVEYANCE METHOD FOR CONVEYING CONVEYANCE MEDIUM

(71) Applicant: SEIKO EPSON CORPORATION, Tokyo (JP)

(72) Inventor: Junya Kato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/302,573

(22) Filed: Jun. 12, 2014

(65) Prior Publication Data

US 2014/0368570 A1 Dec. 18, 2014

(30) Foreign Application Priority Data

Jun. 14, 2013 (JP) ..... 2013-125324

(51) Int. Cl.

| | |
|---|---|
| ***B41J 29/38*** | (2006.01) |
| ***B41J 13/00*** | (2006.01) |
| ***B65H 23/032*** | (2006.01) |
| ***B65H 23/038*** | (2006.01) |

(52) U.S. Cl.

CPC ..... *B41J 13/0009* (2013.01); *B65H 23/038* (2013.01); *B65H 23/0328* (2013.01); *B65H 2301/331* (2013.01); *B65H 2403/942* (2013.01); *B65H 2404/143* (2013.01); *B65H 2801/36* (2013.01)

(58) Field of Classification Search

USPC ..... 347/16

See application file for complete search history.

(56) References Cited

U.S. PATENT DOCUMENTS

| | | | | |
|---|---|---|---|---|
| 8,485,630 | B2 * | 7/2013 | Kawaguchi et al. | 347/16 |
| 2002/0097317 | A1 * | 7/2002 | Wood | B41J 25/316 347/218 |
| 2008/0181707 | A1 * | 7/2008 | Martin et al. | 400/579 |
| 2011/0205278 | A1 | 8/2011 | Haba | |

FOREIGN PATENT DOCUMENTS

| | | | |
|---|---|---|---|
| JP | 08-324846 | A | 12/1996 |
| JP | 2006-268430 | A | 10/2006 |

OTHER PUBLICATIONS

The Extended European Search Report for the corresponding European patent application No. 14172447.6 dated Nov. 3, 2014.

* cited by examiner

*Primary Examiner* — Jason Uhlenhake
(74) *Attorney, Agent, or Firm* — Global IP Counselors, LLP

(57) ABSTRACT

A recording device (conveyance device) includes a recording section configured to perform recording on a recording medium (conveyance medium), a medium supporting section configured to be in a state feeding and pulling back the recording medium and support the recording medium, a detecting portion configured to detect a first arrangement state of the recording medium after being fed from the medium supporting section and before being pulled back and a second arrangement state of the recording medium after being pulled back and fed from the medium supporting section, and an adjusting section configured to select whether or not to process for adjusting an arrangement of the recording medium based on the first arrangement state and the second arrangement state.

13 Claims, 12 Drawing Sheets

RECORDING DEVICE, CONVEYANCE DEVICE, AND CONVEYANCE METHOD FOR CONVEYING CONVEYANCE MEDIUM

CROSS-REFERENCE TO RELATED APPLICATIONS

This application claims priority to Japanese Patent Application No. 2013-125324 filed on Jun. 14, 2013. The entire disclosure of Japanese Patent Application No. 2013-125324 is hereby incorporated herein by reference.

BACKGROUND

1. Technical Field

The present application relates to a recording device, a conveyance device, and a conveyance method for conveying a conveyance medium.

2. Related Art

Some recording devices, such as large-size ink-jet printers, etc., are configured to perform printing at a recoding section while switching a sheet-like recording medium fed from a first rolled paper mounted on a first rolled paper mounting section and a second sheet-like recording medium fed from a second rolled paper mounted on a second rolled paper mounting section. When switching recording media, after rewinding one of the recording media fed to the recording section, the other recording medium is fed to the recording section.

In the technology recited in Japanese Unexamined Laid-open Patent Application Publication No. 2006-268430, which is related to a ticket issuing device, when the first rolled paper is being in use, the second rolled paper is automatically fed so that the front end of the second rolled paper is conveyed to the second feeding conveyance path and held at a sensor position, after rewinding the entire first rolled paper at an arbitrarily timing as a used paper, the second rolled paper is fed to a common conveyance path from the sensor position. The rewound rolled paper is taken out by a person in charge.

In cases where in a state in which one of rolled papers used halfway is rewound and held at a rolled paper mounting section, after using the other rolled paper, the remained one of rolled papers is fed to use, there sometimes causes a skew in which the fed rolled paper is inclined obliquely. In this case, it is necessary to solve the skew, which takes a time to perform the skew correction for solving the skew.

The technology recited in Japanese Unexamined Laid-open Patent Application Publication No. 2006-268430 cannot solve the skew problem mentioned above because the technology is on the premise that a person in charge takes out the rewound rolled paper.

Such problems as mentioned above do not only exist in an ink-jet printer, and similarly exist in various recording devices and conveyance devices.

SUMMARY

In view of the above, one of purposes of the present invention is to provide a technology capable of shortening a time from re-feeding a conveyance medium including a recording medium until performing recording.

As one embodiment of the invention, the recording device has an embodiment including: a recording section configured to perform recording on a recording medium; a medium supporting section configured to be in a state feeding and pulling back the recording medium and support the recording medium; a detecting portion configured to detect a first arrangement state of the recording medium after being fed from the medium supporting section and before being pulled back, and a second arrangement state of the recording medium after being pulled back and then fed from the medium supporting section; and an adjusting section configured to select whether or not to process for adjusting an arrangement of the recording medium is to be performed based on the first arrangement state and the second arrangement state.

That is, it is selected whether or not the arrangement of the recording medium is to be adjusted based on the first arrangement state of the recording medium and the second arrangement state of the recording medium, and therefore the aforementioned embodiment can provide a recording device capable of shortening the time from re-feeding of the recording medium to the execution of recording.

Here, the aforementioned recording device includes an ink-jet printer, a wire dot printer, a laser printer, a line printer, a copier, a facsimile, etc.

The recording medium arrangement state to be detected by the detecting portion includes a posture of the recording medium, a position of the recording medium, a combination thereof, etc.

The adjusting section can perform the processing for adjusting the arrangement of the recording medium when the difference between the first arrangement state and the second arrangement state is equal to or more than a predetermined amount. That is, when the difference between the first arrangement state and the second arrangement state is small, the processing for adjusting the arrangement of the recording medium is not performed. Therefore, this embodiment can shorten the time from re-feeding of the recording medium to the execution of recording.

Here, the difference being equal to or more than the predetermined amount includes both cases: a case in which the value showing the difference is equal to or more than the predetermined value; and a case in which the value showing the difference is larger than the predetermined value.

The recording device can include a conveyance section that conveys the recording medium fed from the medium supporting section. In this case, in the recording device, when the recording medium is pulled back by driving the medium supporting section, the conveyance section can be driven so as to convey the recording medium toward the medium supporting section. When pulling back the recording medium, both of the medium supporting section and the conveyance section are driven, and therefore, in this embodiment, it is possible to reduce an arrangement displacement of the recording medium to be pulled back such as skew.

The recording device can be provided with a second medium supporting section configured to be in a state feeding and pulling back a second recording medium to be recorded at the recording section and support the recording medium. In this case, in the recording device, after an operation of pulling back the recording medium fed from the medium supporting section is initiated, an operation of feeding the second recording medium can be initiated. This embodiment can provide a recording device capable of shortening a time for switching the recording media to be recorded.

In the recording device, the recording medium fed from the medium supporting section can be pulled back to a halfway position to the medium supporting section through which the second recording medium does not pass and the second recording medium can be fed. Since the pulled back recording medium is in a halfway position to the medium supporting section, this embodiment can provide a recording device capable of shortening the time for switching recording media to be recorded.

The recording device can be provided with a common path extending through the recording section, the recording device can be provided with a medium path through which the second recording medium from the second medium supporting section passes to the common path, and the recording device can be provided with a detector configured to detect presence or absence of the second recording medium at a predetermined position in the medium path. In this case, in the recording device, when the recording medium is being fed from the medium supporting section into the common path, the second recording medium can be fed and the second recording medium can be stopped at a standby position located on the common path side than the detector in the medium path, or when the recording medium fed in the common path is pulled back, the second recording medium stopped at the standby position can be fed into the common path. When the recording medium is switched to the second recording medium, the second recording medium is fed from the standby position on a side of the common path than the detector, and therefore, this embodiment can provide a recording device capable of shortening the time for switching recording media to be recorded.

The recording device can be provided with a holding and conveyance section configured to releasably grip the recording medium fed from the medium supporting section, and the recording device can be provided with a holding portion configured to releasably hold the recording medium at a holding position on a downstream side of the holding and conveyance section then the holding and conveyance section in the feeding direction. The adjusting section can perform, as processing for adjusting the arrangement of the recording medium, a control of releasing the holding and conveyance section from gripping the recording medium, holding the recording medium fed to the holding position by the holding portion, adding a force to the recording medium in a pulling back direction from the medium supporting section, holding the recording medium by the holding and conveyance section, and releasing the holding portion from gripping the recording medium. This embodiment can provide an appropriate example for decreasing the arrangement displacement of the recording medium.

The arrangement state of the recording medium can be a position of the edge portion of the recording medium in the feeding direction of the recording medium. This embodiment can provide an appropriate example capable of shortening the time from re-feeding of the recording medium to the execution of recording.

Further, the recording device according to another aspect of the invention has an embodiment comprising: a recording section configured to perform recording on a recording medium; a medium supporting section configured to be in a state capable of feeding and pulling back the recording medium and support the recording medium; a detecting portion that detects an arrangement state of the recording medium that has been re-fed after the recording medium has been fed from the medium supporting section and pulled back toward the medium supporting section; a storing section configured to store a reference arrangement state to be compared with the arrangement state after being re-fed; and an adjusting section configured to select whether or not to process for adjusting an arrangement of the recording medium is to be performed based on the arrangement state after being re-fed and the reference arrangement state.

That is, it is selected whether or not the arrangement of the recording medium is to be adjusted based on the arrangement state after being re-fed and the reference arrangement state, and therefore it is possible to provide a recording device capable of shortening the time from re-feeding of the recording medium to the execution of recording.

Further, the conveyance device according to another aspect of the invention has an embodiment comprising: a medium supporting section configured to be in a state capable of feeding and pulling back a conveyance medium and support the conveyance medium; a detecting portion configured to detect a first arrangement state of the conveyance medium after being fed from the medium supporting section and before being pulled back and a second arrangement state of the conveyance medium after being pulled back and fed from the medium supporting section; and an adjusting section configured to select whether or not to process for adjusting an arrangement of the conveyance medium based on the first arrangement state and the second arrangement state.

That is, it is selected whether or not the arrangement of the conveyance medium is to be adjusted based on the first arrangement state and the second arrangement state, and therefore this embodiment can provide a conveyance device capable of shortening the time from re-feeding the conveyance medium.

Further, the conveyance device according to another aspect of the invention has an embodiment comprising: a medium supporting section configured to be in a state of feeding and pulling back a conveyance medium and support the conveyance medium; a detecting portion configured to detect an arrangement state of the conveyance medium that has been re-fed from the medium supporting section after the conveyance medium has been fed from the medium supporting section and pulled back toward the medium supporting section; a storing section configured to store a reference arrangement state to be compared with the arrangement state after being re-fed; and an adjusting section configured to select whether or not to process for adjusting an arrangement of the conveyance medium based on the arrangement state after being re-fed and the reference arrangement state.

That is, it is selected whether or not the arrangement of the conveyance medium is to be adjusted based on the arrangement state after being re-fed and the reference arrangement state, and therefore this embodiment can provide a conveyance device capable of shortening the time from re-feeding the conveyance medium.

Further, another aspect of the invention has an embodiment such as a conveyance method, etc., for a conveyance medium corresponding to the aforementioned conveyance device.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, embodiments of the present invention will be explained. Needless to say, the following embodiments merely exemplify the present invention, and all of the features shown in the embodiments are not always essential to the solving means of the present invention.

Figure 1:
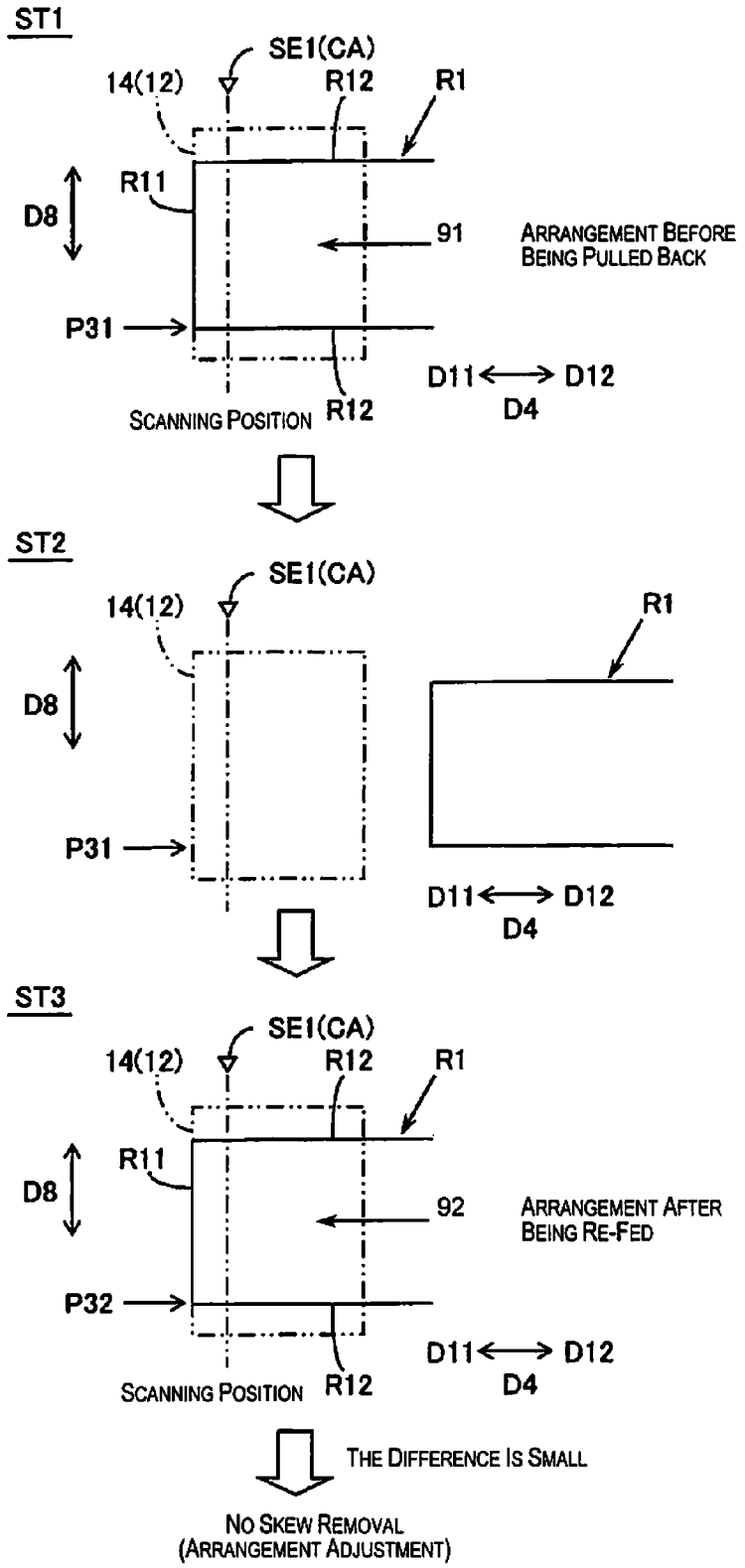
FIG. 1 is a view schematically explaining an example in which no arrangement adjustment of a recording medium is performed.
Figure 2:
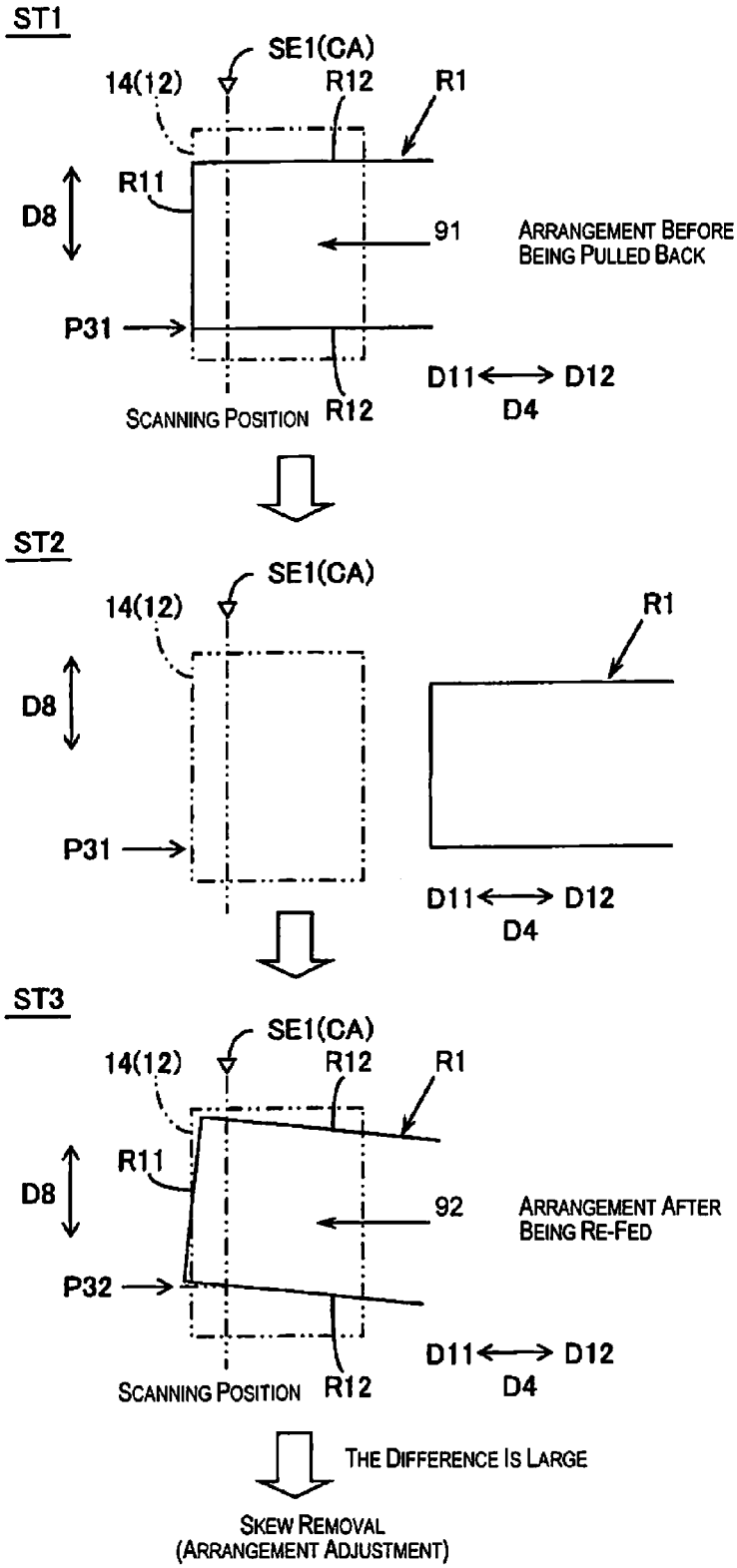
FIG. 2 is a view schematically explaining an example in which an arrangement adjustment of a recording medium is performed.
Figure 3:
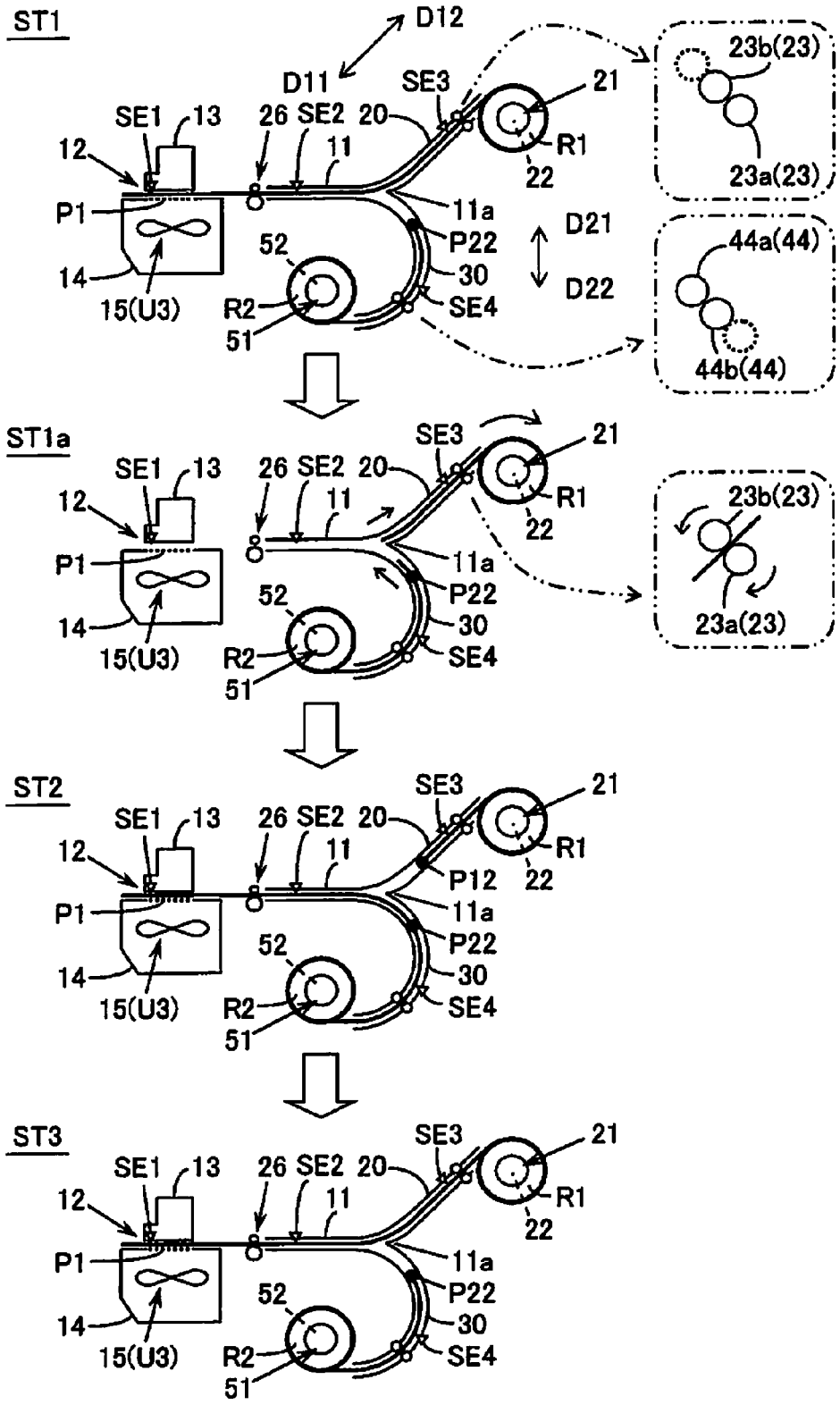
FIG. 3 is a vertical cross-sectional view schematically exemplifying a state of switching recording media.
Figure 4:
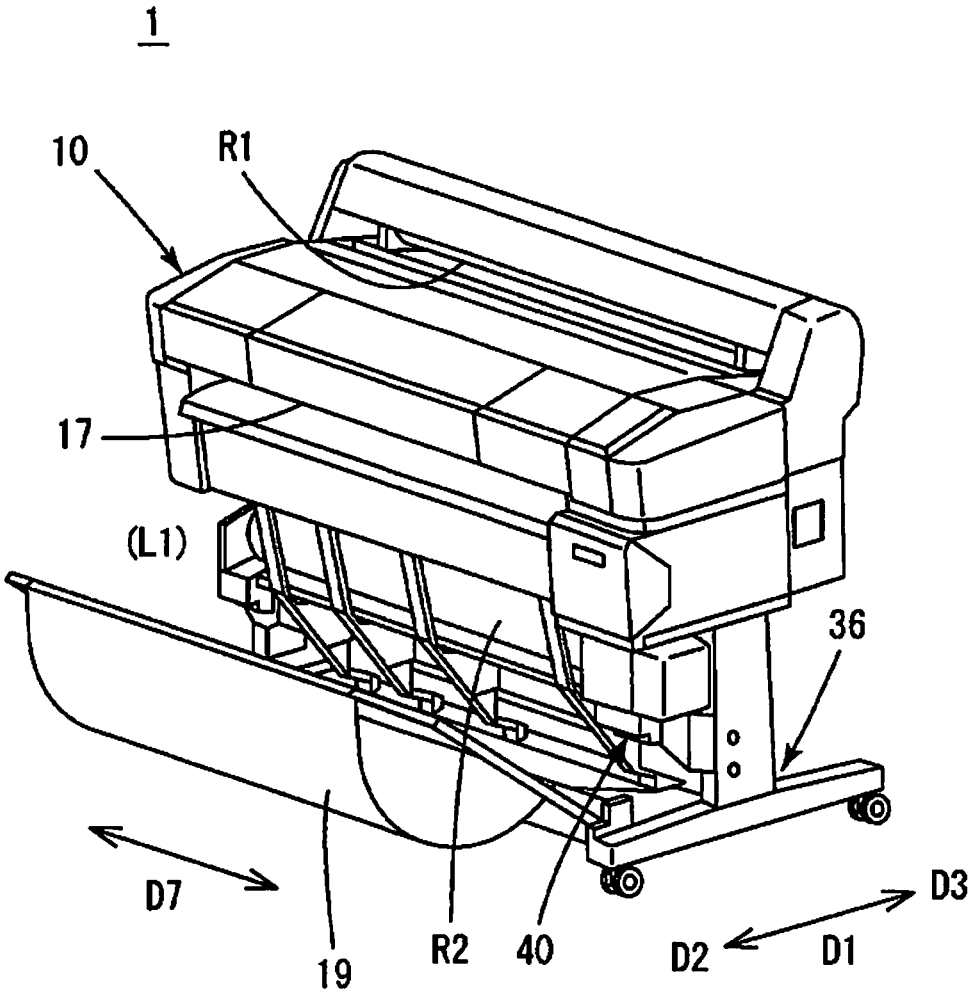
FIG. 4 is a perspective view illustrating an appearance of a recording device 1.
Figure 5:
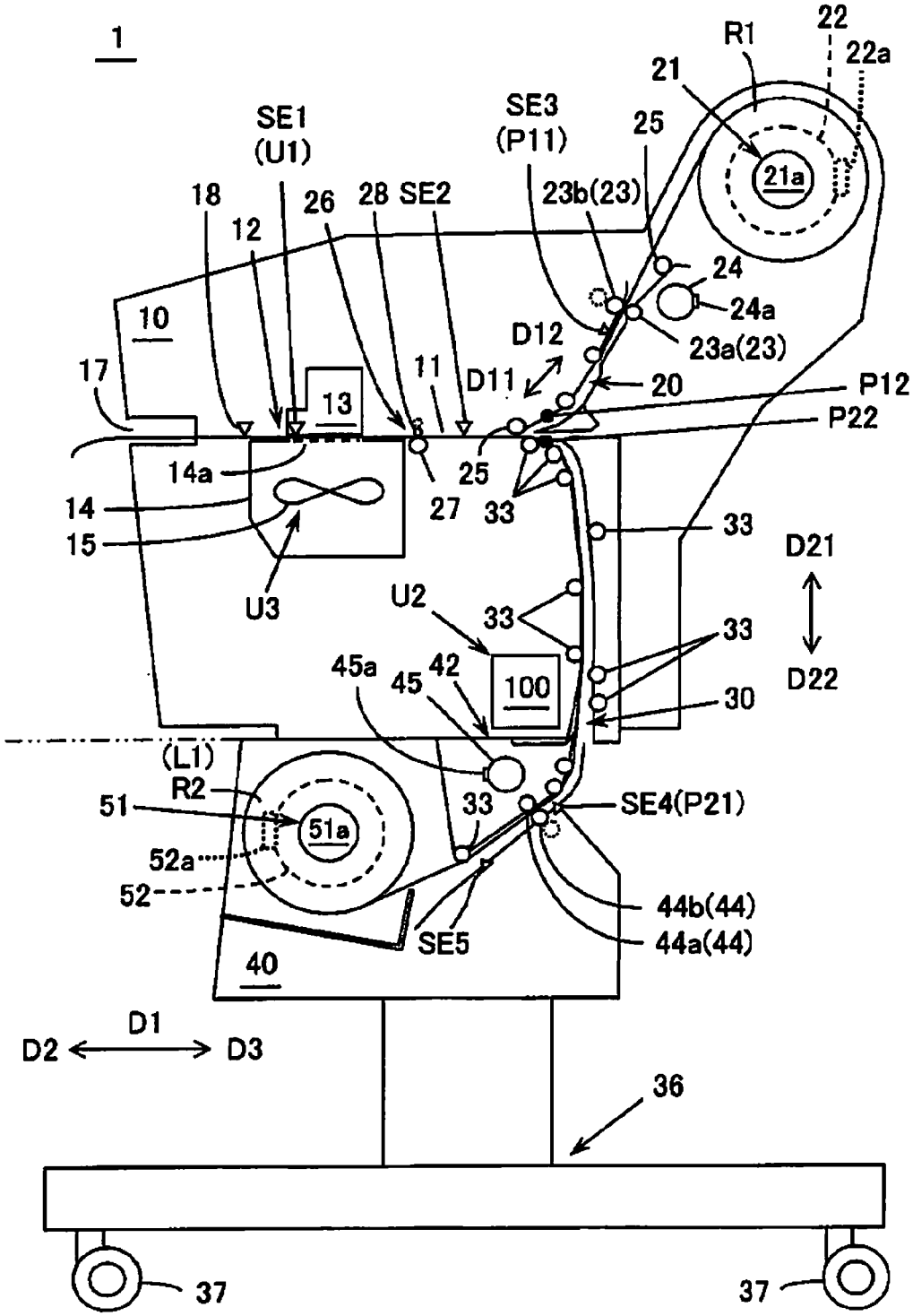
FIG. 5 is a vertical cross-sectional view exemplifying the recording device 1 in a state in which a paper feeding unit 40 is accommodated.
Figure 6:
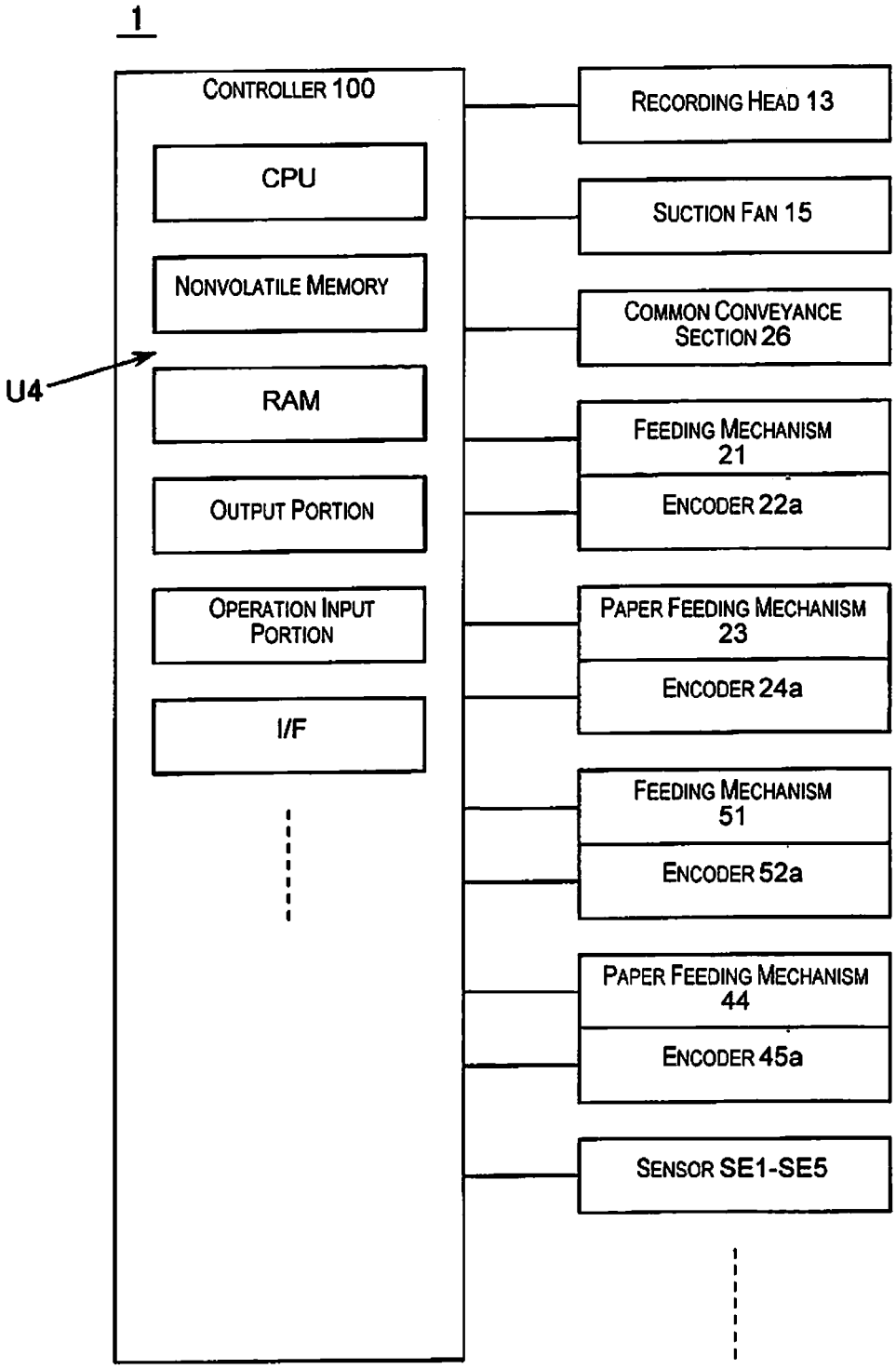
FIG. 6 is a block diagram exemplifying an electrical structure of the recording device 1.

FIG. 1 schematically illustrates an example in which the difference between the arrangement 91 of a recording medium (conveyance medium) before being pulled back and the arrangement 92 of the recording medium after being pulled back and re-fed is small. FIG. 2 schematically shows an example in which the difference of both the arrangements 91 and 92 are large. FIG. 3 is a view for schematically explaining an operation of switching a recording medium R1 and a recording medium R2. FIG. 4 is a perspective view showing an appearance of a large-size ink-jet printer as an example of a recording device (conveyance device) 1. FIG. 5 is a vertical cross-sectional view showing the recording device 1 in which the stacker 19 is not illustrated, and shows a state in which a paper feeding unit 40 is in a predetermined accommodation position L1. FIG. 6 shows an electrical structural example of the recording device 1.

In the aforementioned figures, the symbol D1 denotes slide directions of the paper feeding unit 40 with respect to the main body section 10, the symbol D2 denotes a pullout direction, which is one of the slide directions D1, and the symbol D3 is an accommodation direction, which is the other of the slide directions D1. The symbol D4 shows feeding directions of the recording medium R1, R2, the symbols D11 and D21 show a feeding direction, which is one of the feeding directions D4, and the symbols D12 and D22 show a rewinding direction (pullback direction), which is the other of the feeding direction D4. The symbol D7 shows a design width direction of the recording medium R1 and R2, and shows a recording device width direction perpendicular to the feeding direction D4 in the illustrated example. FIGS. 3 and 5 are side views of the recording device 1 seen from an outside in the width direction D7. The symbol D8 shows a main scanning direction of a carriage CA. The symbols SE1-SE5 each show a sensor for detecting existence or non-existence of the recording medium.

For an easy understanding, in some cases, figures do not match with each other. Further, the positional relation explained in this specification merely an exemplification for explaining the invention, not limiting the invention. Therefore, the embodiment covers the cases that the recording head is arranged at positions other than the position above the platen, for example, a lower position, a front position, a rear position, a left position, or a right position of the platen.

The recording device 1 shown in the aforementioned figures is provided with a main body section 10 including a recording section 12 and a paper feeding unit 40 arranged so as to be relatively movable with respect to the main body section 10, and is capable of executing printing (recording) by switching an upper side rolled paper (recording medium R1) arranged on the upper back portion of the device and a lower side rolled paper (recording medium R2) arranged on the lower portion of the device. The rolled paper is a continuous paper which is a sheet rolled into a rolled manner. In both the rolled papers (R1, R2), the outer side is a printing surface. Of course, by changing the position of the feeding mechanism (medium supporting section) 21 and 51, it becomes possible to use a rolled paper in which the inner side is a printing surface. As the rolled paper, a rolled recording medium made of various materials, such as a paper, a cloth, a plastic sheet, a leather, etc., can be used.

The main body section 10 shown in FIG. 5, etc., is provided with a common path 11, a medium path 20, and a downstream portion of the medium path 30, and further provided with a recording section 12, a feeding mechanism 21, a paper feeding mechanism (conveyance section) 23, a common conveyance section (holding and conveyance section) 26, a discharge section 17, a cutter 18, a stacker 19, a controller 100, etc. Further, the main body section 10 is supported by a leg section 36 having casters 37. The paper feeding unit 40 includes an upstream portion of the medium path 30, and is provided with a mechanical section 42 including a feeding mechanism 51, a paper feeding mechanism (conveyance section) 44, etc.

The common path 11 is a medium path on which the recording section 12 is arranged and also a medium path along which both the recording media R1 and R2 pass through, and includes a sensor SE2 between the branch point 11*a* and the common conveyance section 26. The medium path 20 is a path along which the recording medium R1 from the feeding mechanism 21 passes to the branch point 11*a* (common path 11), and is provided with a roller (driven roller) 25. The medium path 20 includes a sensor SE3 at a predetermined position P11 between the paper feeding mechanism 23 and the branch point 11*a*. The medium path 30 is a path extending from the paper feeding unit 40 to the main body section 10 and a medium path along which the recording medium R2 from the feeding mechanism 51 passes to the branch point 11*a*, and is provided with a roller (driven roller) 33. The medium path 30 includes a sensor SE5 between the feeding mechanism 51 and the paper feeding mechanism 44 and a sensor SE4 at a predetermined position P21 between the paper feeding mechanism 44 and the branch point 11*a*.

Figure 7A:
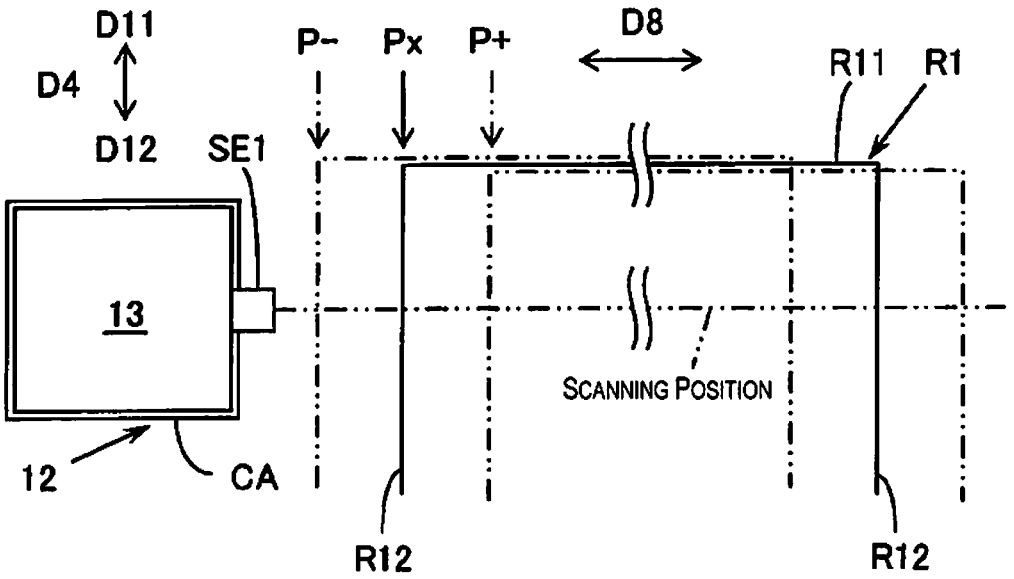
FIG. 7A is a view schematically exemplifying a state of detecting an arrangement state of the recording medium.

The recording section 12 is provided with a recording head 13 and a platen 14, and is configured to perform printing on the recording medium passing the common path 11. The recording head 13 is arranged on an opposed upper side of the platen 14 to eject ink to the recording medium in a recordable manner. The upper surface of the platen 14 is a recording medium supporting surface having a plurality of air suction apertures 14*a*. The platen 14 has, in its inner portion, a suction fan 15. The suction fan 15 and the air suction aperture 14*a* constitute a holding portion U3 for releasably holding the recording medium at a holding position P1 on a downstream side of the common conveyance section 26 in the feeding direction. The platen 14 supports the recording medium and keeps a predetermined distance between the recording medium and the recording head 13. As shown in FIG. 7A, the carriage CA mounting the recording head 13 has a sensor SE1, and is reciprocatively movable in the main scanning direction D8.

The feeding mechanisms 21 and 51 are provided with a holder 21*a* and 51*a* and motors 22 and 52, respectively, and are capable of feeding and rewinding (pulling back) the rolled paper (recording medium R1 and R2) while rotatably supporting it. Therefore, the feeding mechanism 21 and 51 is a medium supporting section which is in a state capable of feeding and pulling back the recording medium and is configured to support the recording medium. The holder 21*a*, 51*a* is arranged at both end portions of the rolled paper (R1, R2) to support both end portions of the rolled paper (R1, R2). The motor 22, 52 is a servomotor having an encoder 22*a*, 52*a*, and rotates the holder 21*a*, 51*a* in the feeding direction and in the rewinding direction.

The paper feeding mechanism (conveyance section) 23, 44 is provided with a pair of paper feeding rollers (23*a*, 23*b*), (44*a*, 44*b*) and a motor 24, 45 to convey the recording medium R1, R2 fed from the feeding mechanism 21, 51. The upper side pair of paper feeding rollers are provided with a drive roller 23*a* arranged on the lower side and a driven roller 23*b* arranged on the upper side. The lower side pair of paper feeding rollers are provided with a drive roller 44*a* arranged on the upper side and a driven roller 44*b* arranged on the lower side. The driven roller 23*b*, 44*b* is detachable from the drive roller 23*a*, 44*a*, and grips the recording medium R1, R2 in corporation with the drive roller 23*a*, 44*a* when closely approached the drive roller. The motor 24, 45 is a servomotor having an encoder 24*a*, 45*a*, and rotates the drive roller 23*a*, 44*a*.

The common conveyance section (holding and conveyance section) 26 is provided with a pair of conveyance rollers (27, 28) and a servomotor, which is not illustrated, and is configured to releasably grip the recording medium R1 fed from the feeding mechanism 21. The pair of conveyance rollers is provided with a drive roller 27 arranged on the lower side and a driven roller 28 arranged on the upper side. The driven roller 28 is detachable from the drive roller 27, and grips the recording medium in corporation with the drive roller 27 when closely approached the drive roller. The servomotor includes an encoder and rotates the drive roller 27.

The recording medium fed from the discharge section 17 is cut with the cutter 18 and stacked in the stacker 19.

The controller 100 shown in FIG. 6 includes a CPU (Central Processing Unit), a ROM (Read Only Memory) such as a nonvolatile memory, a RAM (Random Access Memory), an output portion such as a displaying portion, an operation input portion, an I/F (interface), etc., and controls the operation of each section of the recording device 1, such that, for example, it receives recording data from an outside host device and prints the data on the recording medium. To the controller 100, the recording head 13, the suction fan 15, the common conveyance section 26, the feeding mechanism 21 and 51 including the encoders 22*a* and 52*a*, the paper feeding mechanisms 23 and 44 including encoders 24*a* and 45*a*, sensors SE1-SE5, etc., are connected.

The recording device 1 is equipped with a detecting portion U1 for detecting a first arrangement state of the recording medium R1, R2 after being fed from the feeding mechanism 21, 51 but before being pulled back and a second arrangement state of the recording medium R1, R2 after being pulled back and then fed from the feeding mechanism 21, 51. The arrangement state of the recording medium R1, R2 means an object to be detected by the detecting portion U1. The detecting portion U1 is constituted by, for example, the sensor SE1 and the controller 100. Further, the recording device 1 is provided with an adjusting section U2 which selects whether or not processing for adjusting the arrangement 92 of the recording medium R1, R2 is performed, based on the first arrangement state which is a before-pulled-back arrangement of the recording medium R1, R2 and the second arrangement which is an after-refed arrangement of the recording medium R1, R2. The adjusting section U2 is configured to adjust, for example, the after-re-fed arrangement 92 of the recording medium R1, R2 when the difference between the before-pulled-back arrangement 91 and the after-refed arrangement 92 is equal to or more than a predetermined amount. The adjusting section U2 is constituted by, for example, a controller 100.

For example, explaining with reference to FIGS. 1 to 3, there is a case in which after using the recording medium R1 as the first recording medium as shown in Step ST1 (hereinafter, the wording "Step" will be omitted), the recording medium R2 as the second recording medium is used depending on the recording data as shown in ST2. In this case, it is required to rewind the recording medium R1 halfway and then feed the recording medium R2. In this recording device 1, the first arrangement state of the recording medium R1 arranged in the recording section 12 is detected by the detecting portion U1 and saved before rewinding the recording medium. The first arrangement state shown in FIGS. 1 and 2 is a state of the before-pulled-back arrangement 91 of the recording medium R1.

Thereafter, there are cases where the recording medium R1 is again used depending on the recording data as shown in ST3. In this case, it is required to rewind the recording medium R2 to feed the recording medium R1 used halfway. In this recording device 1, the second arrangement state of the recording medium R1 fed again to the recording section 12 is detected by the detecting portion U1 and stored. The second arrangement state shown in FIGS. 1 and 2 is a state of the after-re-fed arrangement 92 of the recording medium R1.

FIG. 7A schematically illustrates the state of detecting the arrangement state of the recording medium R1. The sensor SE1 provided on the carriage CA detects the existence or nonexistence of the recording medium R1 fed to the recording section 12 while moving in the main scanning direction D8. The detecting portion U1 detects the position Px of the edge portion R12 of the recording medium R1 in the main scanning direction D8 from the position of the sensor SE1 in the main scanning direction D8 and the detection signal from the sensor SE1. When the position of the recording medium R1 in the main scanning direction D8 is shifted toward one side (right side in this figure), the position P+ is detected, and when the position of the recording medium R1 in the main scanning direction D8 is shifted toward the other side (left side in this figure), the position P− is detected.

Figure 7B:
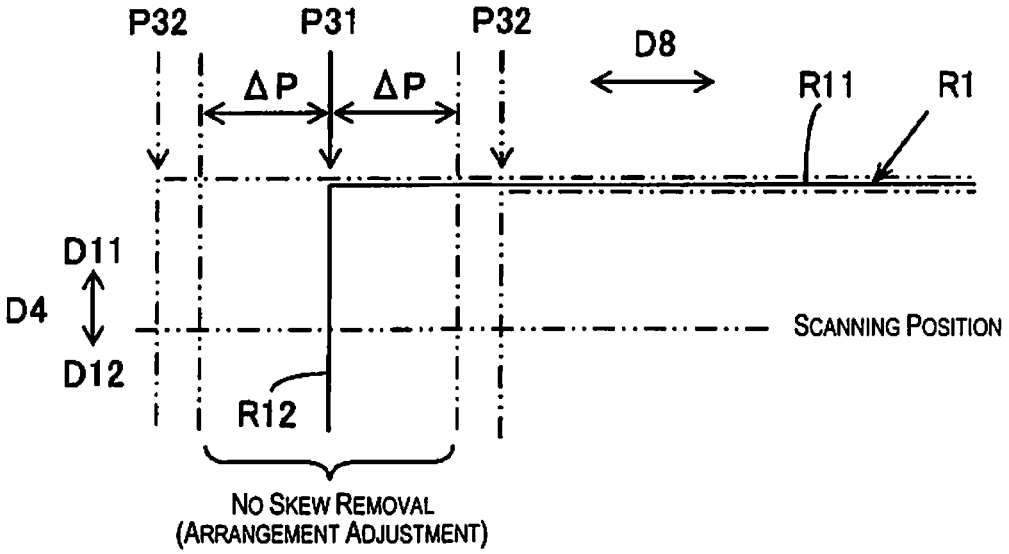
FIG. 7B is a figure schematically exemplifying a state of deciding the availability of the arrangement adjustment.

FIG. 7B schematically illustrates the state of deciding the necessity of the arrangement adjustment based on the position to be detected. The symbol P31 denotes the position of the edge portion R12 of the recording medium R1 in the feeding direction D4 of the recording medium R1 before the recording medium is rewound (pulled back). The symbol P32 denotes the position of the edge portion R12 after re-feeding of the recording medium. The symbol ΔP denotes a predetermined amount (positive value) showing whether or not an arrangement adjustment called "skew correction" should be performed depending on the position P32 after re-feeding of the recording medium with reference to the position P31 before rewinding the recording medium. When the position P32 after re-feeding the recording medium is within the range of the predetermined amount ΔP with reference to the position P31 before rewinding of the recording medium, no arrangement adjustment is performed. Needless to say, the same can be applied to the recording medium R2.

ST3 shown in FIG. 1 illustrates an example in which the difference between both the arrangements 91 and 92 is small. This example shows the case in which the difference between the position P31 of the edge portion R12 of the recording medium R1 in the main scanning direction D8 before being rewound and the position P32 of the edge portion R12 in the main scanning direction D8 after being re-fed is less than the predetermined amount. That the difference is less than the predetermined amount includes both cases: a case in which the value showing the difference is less than the predetermined value; and a case in which the value showing the difference is equal to or less than the predetermined value. It should be understood that the expressions of "less than" and "equal to or larger than" are used because of mere expressional restrictions and do not limit the technical concept. The same can also be applied to the recording medium R2.

In this recording device 1, when the difference between both the arrangements 91 and 92 are less than the predetermined amount, print processing can be executed promptly without performing the processing for adjusting the arrangement 92 after being re-fed such as a skew correction.

ST3 shown in FIG. 2 illustrates an example in which the difference between both the arrangements 91 and 92 is large. This example shows a case in which the position P31 before being rewound and the position P32 after being re-fed is equal to or larger than the predetermined amount, and the difference of the postures of the front end portion R11 and the edge portion R12 of the recording medium R1 is equal to or larger than the predetermined amount. The same can be applied to the recording medium R2.

In this recording device 1, when the difference between both the arrangements 91 and 92 is equal to or larger than the predetermined amount, processing for adjusting the arrangement 92 after being re-fed is executed.

The arrangement of the recording medium to be detected with the detecting portion U1 can be, other than the position of the edge portion R12 in the main scanning direction D8, the position of both end portions of the front end portion R11 of the recording medium in the feeding direction D4, the posture of the front end portion R11 (the angle showing the inclination with respect to the main scanning direction D8), the posture of the edge portion R12 (angle showing the inclination with respect to the feeding direction D4), etc. For example, by creating the existence or nonexistence information of the recording medium two dimensionally by repeating the main scanning of the sensor SE1 while feeding the recording medium, the posture of the front end portion R12 and/or the posture of the edge portion R12 can be detected, and the detected posture can be used for the judgment for the necessity of the arrangement adjustment.

In the recording device 1, it is selected whether or not the arrangement of the recording medium R1 is to be adjusted based on the first arrangement state before pulling back the recording medium R1 and the second arrangement state after re-feeding the recording medium R1, and therefore it is possible to shorten the time from re-feeding of the recording medium R1 to the execution of recording. Further, in the recording device 1, no processing for adjusting the arrangement 92 of the recording medium R1 after being re-fed when the difference between both the arrangements 91 and 92 is small, and therefore it is possible to shorten the time from re-feeding of the recording medium R1 to the execution of recording.

Further, in this recording device 1, as shown in ST1*a* in FIG. 3, when rewinding the recording medium R1 by driving the feeding mechanism 21, the paper feeding mechanism (conveyance section) 23 is driven so as to convey the recording medium R1 toward the feeding mechanism 21. For example, when rewinding the recording medium R1 by rotatably driving the feeding mechanism 21 in the rewinding direction, without detaching the rollers 23*a* and 23*b* of the paper feeding mechanism 23, the drive roller 23*a* is rotatably driven with the motor 24 with the recording medium R1 gripped by rollers 23*a* and 23*b*. Rewinding the recording medium R1 with the rollers 23*a* and 23*b* detached may cause an arrangement displacement called skew, but such displacement can be controlled by rotatably driving the drive roller 23*a* so as to convey the recording medium R1 in the rewinding direction D12 with the recording medium R1 gripped by the rollers 23*a* and 23*b*. When rewinding the recording medium R2 by driving the feeding mechanism 51, it also can get the similar effect by driving the paper feeding mechanism 44 so as to drive the recording medium R2 toward the feeding mechanism 51.

From the above, the recording device according to the embodiment has an embodiment including: a recording section for performing recording on a recording medium; a medium supporting section which is in a state of capable of feeding and pulling back the recording medium and is configured to support the recording medium; and a conveyance section for conveying the recording medium fed from the medium supporting section. When the recording medium is pulled back by driving the media supporting section, the conveyance section is driven so as to convey the recording medium toward the medium supporting section. In this embodiment, when rewinding the recording medium, both of the medium supporting section and the conveyance section are driven, and therefore it is possible to reduce an arrangement displacement of the recording medium to be pulled back such as a skew.

Further, in this recording device 1, as shown in ST2 in FIG. 3, to use the recording medium R1 fed from the feeding mechanism 21 later, the recording medium R1 is rewound to the halfway position (P12) to the feeding mechanism 21, and the second recording medium R2 is fed. The halfway position (P12) is positioned within the medium path 20 through which the second recording medium R2 does not travel. In this way, when feeding the recording medium R1 again, it is possible to quickly feed the recording medium R1 from the halfway position (P12) close to the branch point 11*a* to the recording section 12. The same can be applied to the case in which the recording medium R2 is rewound to the halfway position (P22) to feed the recording medium R1.

From the above, the recording device of the embodiment has an embodiment including: a first medium supporting section which is in a state capable of feeding and pulling back the first recording medium and is configured to support the recording medium; a second medium supporting section which is in a state capable of feeding and pulling back the second recording medium and is configured to support the recording medium; and a recording section for recording to the first recording medium and the second recording medium. The first recording medium fed from the first medium supporting section is pulled back to a halfway position to the first medium supporting section through which the second recording medium does not pass and the second recording medium is fed. In this embodiment, it is possible to shorten the time to switch from the second recording medium to the first recording medium.

Further, in this recording device 1, as shown in ST1 in FIG. 3, when the recording medium R1 is being fed from the feeding mechanism 21 to the common path 11, the second recording medium R2 is fed and the second recording medium R2 is stopped at a standby position P22 located on the common path 11 side than the sensor (detector) SE4 in the medium path 30. When the recording medium R1 fed in the common path 11 is pulled back, as shown in ST1*a*, the second recording medium R2 stopped at the standby position P22 is fed to the common path 11. In this way, when feeding the second recording medium R2, it is possible to quickly feed the second recording medium R2 from the standby position P22 closer to the branch point 11*a* than the sensor SE4 to the recording section 12. The same can be applied to the case when stopping the recording medium R1 at the standby position P12 and feeding the recording medium R1 which was being stopped to the common path 11.

From the above, the recording device according to the embodiment has an embodiment including: a first medium supporting section which is in a state capable of feeding and pulling back the first recording medium and is configured to support the recording medium; a second medium supporting section which is in a state capable of feeding and pulling back the second recording medium and is configured to support the recording medium; a recording section for recording to the first recording medium and the second recording medium; a common path extending through the recording section; a medium path through which the second recording medium from the second medium supporting section to the common path; and a detector for detecting a presence or absence of the second recording medium at a predetermined position in the medium path. When the first recording medium is being fed from the medium supporting section into the common path, the second recording medium is fed and the second recording medium is stopped at the standby position located on the common path side than the detector in the medium path, and when the first recording medium fed in the common path 11 is pulled back, the second recording medium stopped at the standby position is fed to the common path. In this embodiment, it is possible to shorten the time to switch from the first recording medium to the second recording medium.

Next, an example of the operation of the recording device 1 will be explained.

Figure 8:
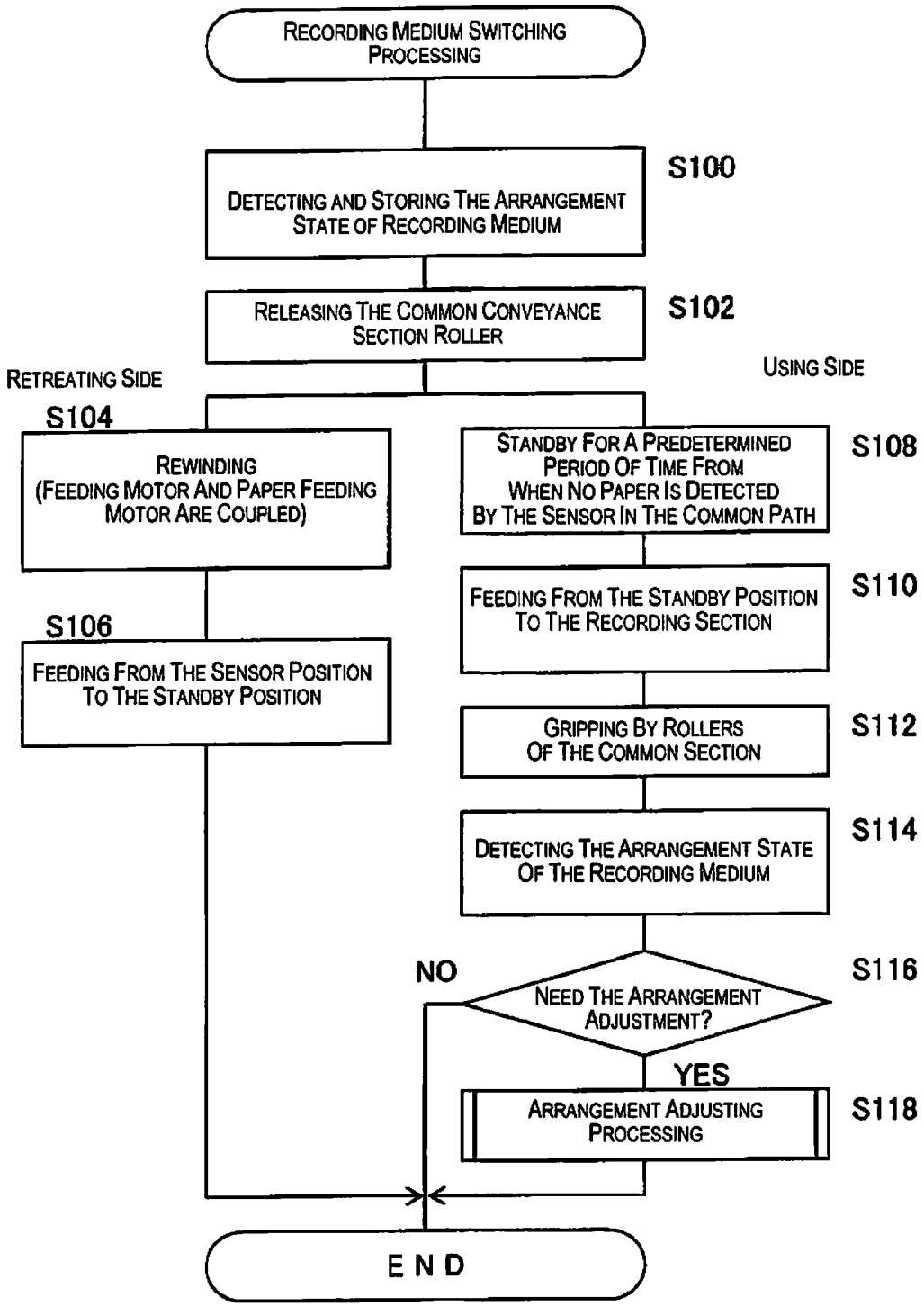
FIG. 8 is a flow chart exemplifying recording medium switching processing.

FIG. 8 illustrates recording medium switching processing performed in the recording device 1. This processing is executed mainly by the controller 100 and initiated when, for example, recording data is data that requires switching of recording media. When new recording medium R1, R2 is mounted on the feeding mechanism 21, 51, the recording device 1 feeds the recording medium R1, R2 so that the front end portion of the recording medium R1, R2 reaches the standby position P12, P22 located on a downstream side than the sensor SE3, SE4 and hold the recording medium R1, R2 there.

Upon initiation of the processing, the recording device 1 detects the arrangement state of the recording medium in the recording section 12 and stores it in a memory (Step S100, hereinafter "Step" will be omitted). For example, as shown in FIG. 7A and FIG. 7B, the position P31 of the end portion of the recording medium before rewinding the recording medium along the feeding direction D4 of the recording medium is detected using the sensor SE1 that performs main scanning, and the position is stored in a memory (nonvolatile memory or RAM). In S102, the rollers 27 and 28 of the common conveyance section 26 are pulled away from each other to release the gripping of the recording medium R1. Thereafter, the processing (S104-S106) for rewinding the recording medium in the recording section 12 and the processing (S108-S118) for feeding the recording medium which was being standby to the recording section 12 are performed in parallel.

Figure 9:
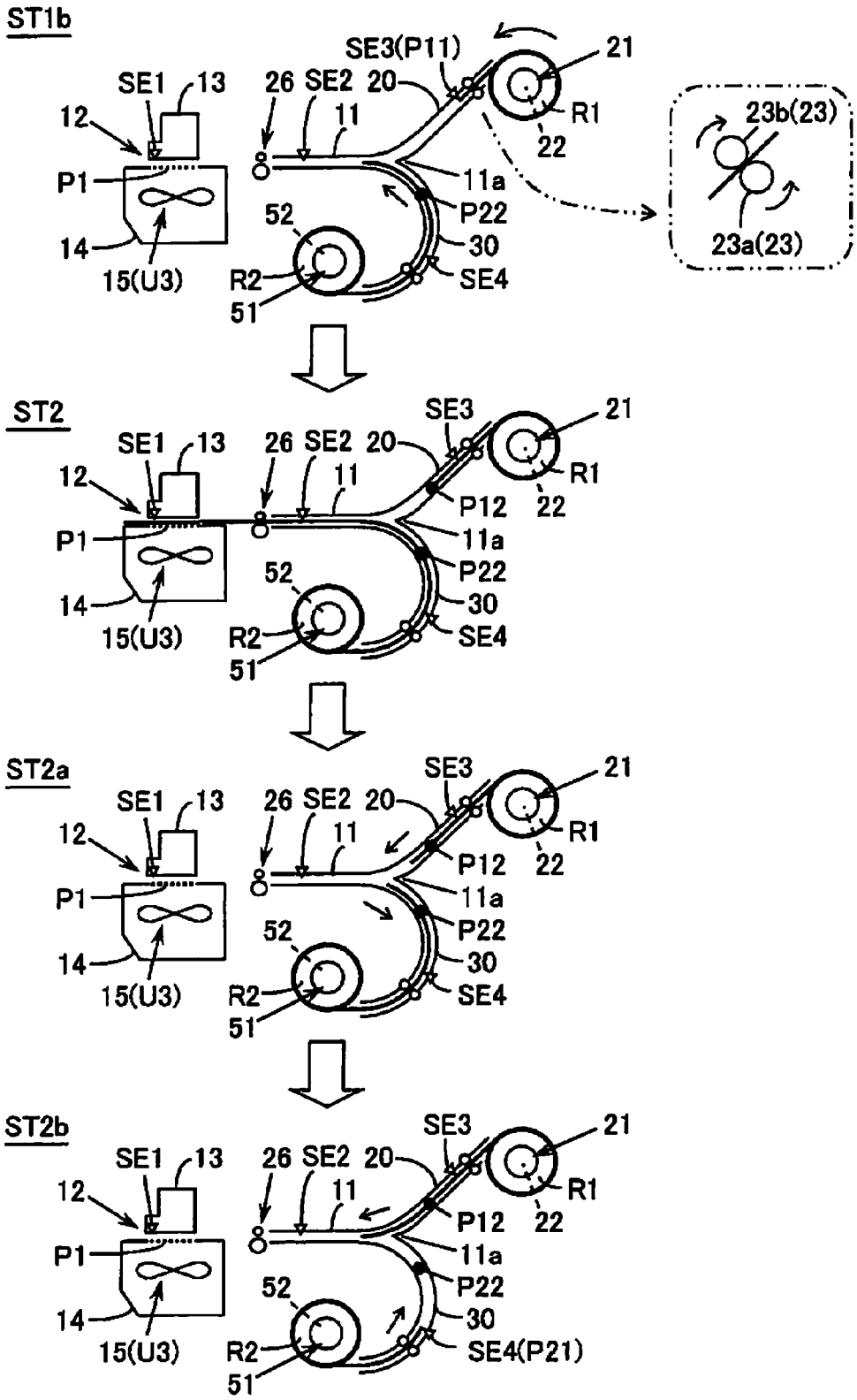
FIG. 9 is a vertical cross-sectional view schematically exemplifying a state of standing by a recording medium.

When switching from the recording medium R1 to the recording medium R2, in S104 which is a step for rewinding the recording medium R1, as shown in ST1 and ST1*a* in FIG. 3, and ST1*b* in FIG. 9, the recording medium R1 is rewound so that the front end portion of the recording medium R1 reaches the position P11 of the sensor SE3. At this time, in the recording device 1, the feeding mechanism 21 is rotatably driven in the rewinding direction, and the drive roller 23*a* is rotatably driven in the rewinding direction with the recording medium R1 gripped by the rollers 23*a* and 23*b* of the paper feeding mechanism 23. With this, the arrangement displacement of the recording medium R1 is controlled.

In S106, as shown in ST1*b* in FIG. 9 and ST2 in FIG. 3, the recording medium R1 is fed until the front end portion of the recording medium R1 reaches the standby position P12, and then the processing is terminated. At this time, in the recording device 1, the drive roller 23*a* gripping the recording medium R1 together with the driven roller 23*b* is rotatably driven in the feeding redirection, and the feeding mechanism 21 is rotatably driven in the feeding direction. The feeding from the position P11 of the sensor to the standby position P12 can be controlled by counting the number of pulses of the encoder 24*a*.

On the other hand, in S108 in which the recording medium R2 is fed, in order to prevent the recording media R1 and R2 from coming into contact with each other in the common path 11, the recording medium R1 waits for a predetermined period of time after the sensor SE2 in the common path 11 detects that no recording medium exists. This predetermined period of time can be a period of time during which the front end portion of the recording medium R1 comes in the medium path 20, or can be a period of time during which the front end portion of the recording medium R1 remains in the common path 11. The predetermined period of time can be controlled by, for example, counting the number of pulses of the encoder 22*a*. In S110, as shown in ST1*a* in FIG. 3 and ST1*b* and ST2 in FIG. 9, the recording medium R2 is fed until the front end portion of the recording medium R2 reaches the position of the recording section 12. At this time, in the recording device 1, the drive roller 44*a* gripping the recording medium R2 together with the driven roller 44*b* is rotatably driven in the feeding redirection, and the feeding mechanism 51 is rotatably driven in the feeding direction. As mentioned above, in this recording device 1, the feeding operation of the recording medium R2 is initiated after the initiation of the rewinding operation of the recording medium R1 fed from the feeding mechanism 21, and therefore it is possible to shorten the time required for switching the recording medium R1.

In S112, the rollers 27 and 28 of the common conveyance section 26 got closer to grip the recording medium R2 with the rollers 27 and 28. In S114, the arrangement state of the recording medium R2 in the recording section 12 is detected. For example, as shown in FIG. 7A and FIG. 7B, the position P32 of the end portion of the recording medium R2 along the feeding direction D4 of the recording medium R2 is detected using the sensor SE1 that performs main scanning, and the position is stored in a memory. In cases where the position P31 of the recording medium R2 before being rewound is stored, the position P32 to be detected is a position (arrangement 92) after being refed. In S116, it is judged whether or not there is a need to perform processing for adjusting the arrangement of the recoding medium R2. For example, when the difference between the position P31 before being rewound and the position P32 after being re-fed is equal to or more than a predetermined amount ΔP, the processing is terminated after performing the arrangement adjustment processing (S118), while when the difference between the positions P31 and P32 is less than the predetermined amount ΔP, the processing is terminated as it is.

Figure 10:
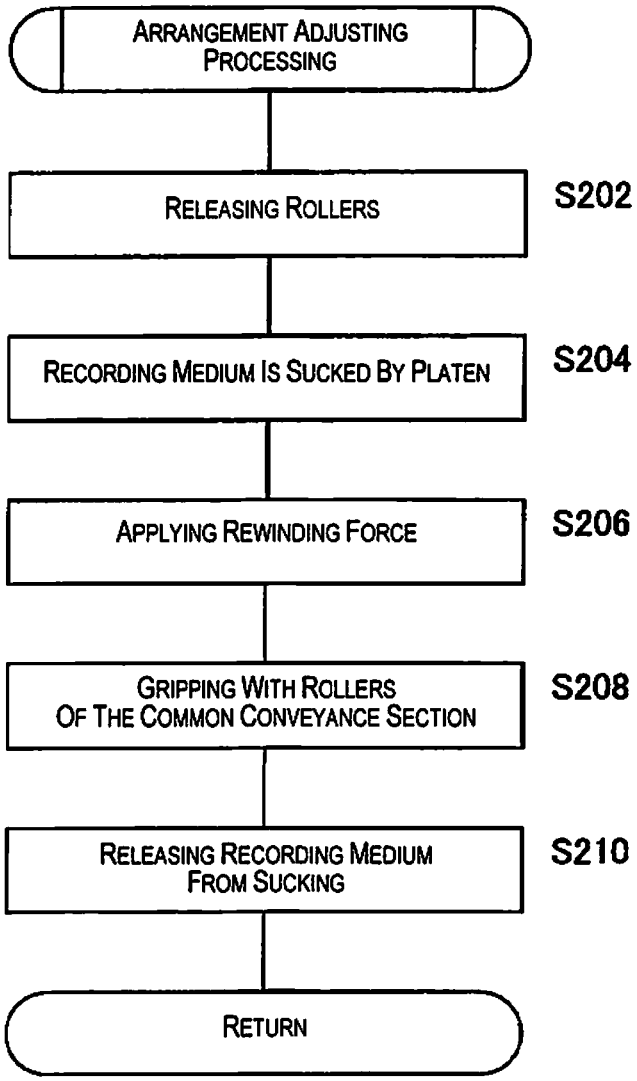
FIG. 10 is a flow chart exemplifying arrangement adjustment processing.

FIG. 10 illustrates the arrangement adjusting processing performed in S118. Upon initiation of the processing, the rollers 27 and 28 arranged in the common path 11 are distanced to release the gripping of the recording medium R2 by the common conveyance section 26. In cases where the rollers 44*a* and 44*b* of the paper feeding mechanism 44 in the medium path 30 grips the recording medium R2, the rollers 44*a* and 44*b* are distanced to release the gripping of the recording medium R2 by the paper feeding mechanism 44 (S202). In cases where there exist arrangement displacements such as skews by the common conveyance section 26 or the paper feeding mechanism 44, the posture and/or the position of the recording medium R2 changes so as to solve the arrangement displacements by releasing the gripping. In S204, the recording medium R2 on the holding position P1 is sucked (held) to the platen 14 by driving the suction fan 15. In S206, the feeding mechanism 51 is rotatably driven in the rewinding direction to apply a force from the feeding mechanism 51 in the rewinding direction D22 to the recording medium R2. In S208, the rollers 27 and 28 are got closer to grip the recording medium R1 by the common conveyance section 26. In S210, the recording medium R2 is released from the sucking by the platen 14 by stopping the driving of the suction fan 15, and the processing is terminated.

With this, the arrangement displacement correction of the recording medium R2 such as a skew correction is performed. Therefore, the aforementioned example is an appropriate example for decreasing the arrangement displacement of the recording medium.

When switching from the recording medium R2 to the recording medium R1, in S104 which is a step for rewinding the recording medium R2, as shown in ST2, ST2*a* and ST2*b* in FIG. 9, the recording medium R2 is rewound to the position P21 of the sensor SE4. At this time, in the recording device 1, the feeding mechanism 51 is rotatably driven in the rewinding direction, and the drive roller 44*a* is rotatably driven in the rewinding direction with the recording medium R2 gripped by the rollers 44*a* and 44*b* of the paper feeding mechanism 44. With this, the arrangement displacement of the recording medium R2 is controlled.

In S106, as shown in ST2*b* in FIG. 9 and ST3 in FIG. 3, the recording medium R1 is fed to the standby position P12, and then the processing is terminated. At this time, in the recording device 1, the drive roller 23*a* gripping the recording medium R1 together with the driven roller 23*b* is rotatably driven in the feeding redirection, and the feeding mechanism 21 is rotatably driven in the feeding direction.

On the other hand, in S108 which is a step of feeding the recording medium R1, the recording medium R1 waits for a certain period of time after the sensor SE2 in the common path 11 detects that no recording medium exists. In S110, as shown in ST2*a* and ST2*b* in FIG. 9 and ST3 in FIG. 3, the recording medium R1 is fed to the recording section 12. At this time, in the recording device 1, the drive roller 23*a* gripping the recording medium R1 together with the driven roller 23*b* is rotatably driven in the feeding redirection, and the feeding mechanism 21 is rotatably driven in the feeding direction. In this way, in this recording device 1, when feeding the recording medium R1 again, the recording medium R1 is fed quickly from the standby position P12 closer to the branch point 11*a* to the recording section 12, and therefore the time required to switch from the recording medium R2 to the recording medium R1 can be short.

In S112, the recording medium R1 is gripped with the rollers 27 and 28 of the common conveyance section 26. In S114, the arrangement state of the recording medium R1 in the recording section 12 is detected. In S116, it is judged whether or not there is a need to perform processing for adjusting the arrangement of the recording medium R1. For example, when the difference between the position P31 (arrangement 91) before being rewound and the position P32 (arrangement 92) after being re-fed again is equal to or more than a predetermined amount ΔP, the processing is terminated after performing the arrangement adjustment processing (S118), while when the difference between the positions P31 and P32 is less than the predetermined amount ΔP, the processing is terminated as it is.

As explained above, it is selected whether or not the arrangement of the recording medium R1 is to be adjusted based on the first arrangement state before pulling back the recording medium R1 and the second arrangement state after re-feeding the recording medium R1, and therefore it is possible for the recording device 1 to shorten the time from re-feeding of the recording medium R1 to the execution of recording. When the difference between the arrangement 91 of the recording medium before being pulled-back and the arrangement 92 of the recording medium after being re-fed is as large as the predetermined amount ΔP or more, processing for adjusting the arrangement 92 of the recording medium after being re-fed is performed. On the other hand, in cases where the difference between both the arrangements 91 and 92 is as small as less than the predetermined amount ΔP, the processing for adjusting the arrangement 92 of the recording medium after being re-fed is not performed. Therefore, in the recording device 1, it is possible to shorten the time from re-feeding of the recording medium R1 to the execution of recording.

The wording "second" of the aforementioned second recording medium is an expression showing the relative relationship of the recording medium different from the second recording medium. Therefore, in construing the technical scope of the present invention, it is naturally acceptable to recognize the recording medium R2 as the second recording medium in one situation and to recognize the recording medium R1 as the second recording medium in another situation different from the one situation.

In the meantime, it can be configured to compare, instead of the arrangement state of the recording medium before being pulled-back to be detected by the detecting portion U1, an arrangement state of a standard which is nothing to do with the arrangement before being pulled-back, with the arrangement state of the recording medium after being re-fed. As an example that realizes this embodiment, the recording device 1 can be equipped with the detecting portion U1 that detects the arrangement state (arrangement 92) of the recording medium R1, R2 fed from the medium supporting section (21, 51) after pulled-back toward the medium supporting section (21, 51) fed from the medium supporting section (21, 51), the recording section U4 (see FIG. 6) for storing the reference arrangement state (reference arrangement 93) to be compared with the arrangement state after being re-fed, and the adjusting section U2 for selecting whether or not the processing for adjusting the arrangement of the recording medium R1, R2 based on the arrangement state after being re-fed and the reference arrangement state. The storage section U4 is constituted by memories, such as, for example, a nonvolatile memory or a RAM as shown in FIG. 6, which store the reference arrangement state.

Figure 11:
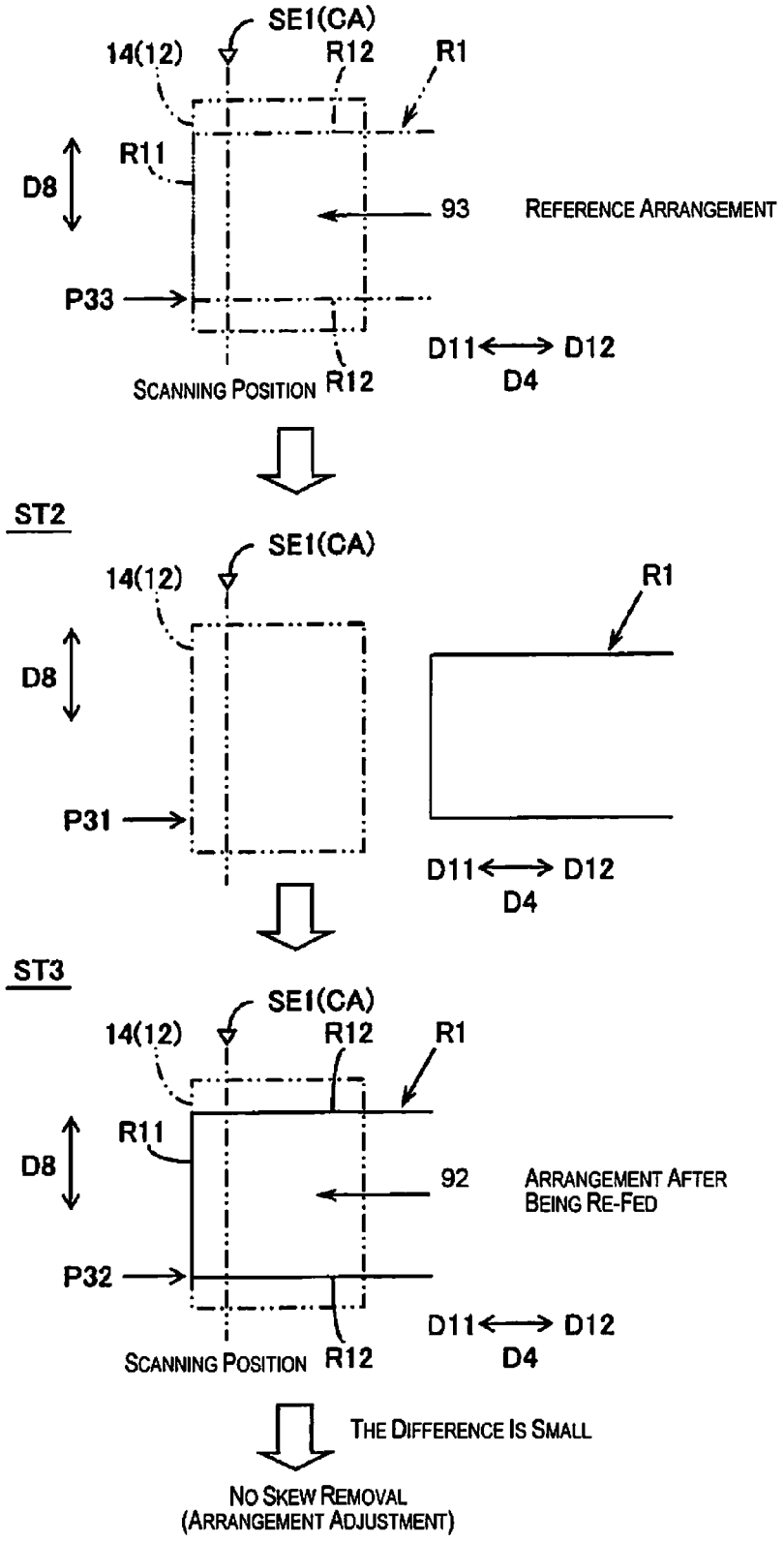
FIG. 11 is a view schematically exemplifying an example in which no arrangement adjustment of the recording medium is performed.
Figure 12:
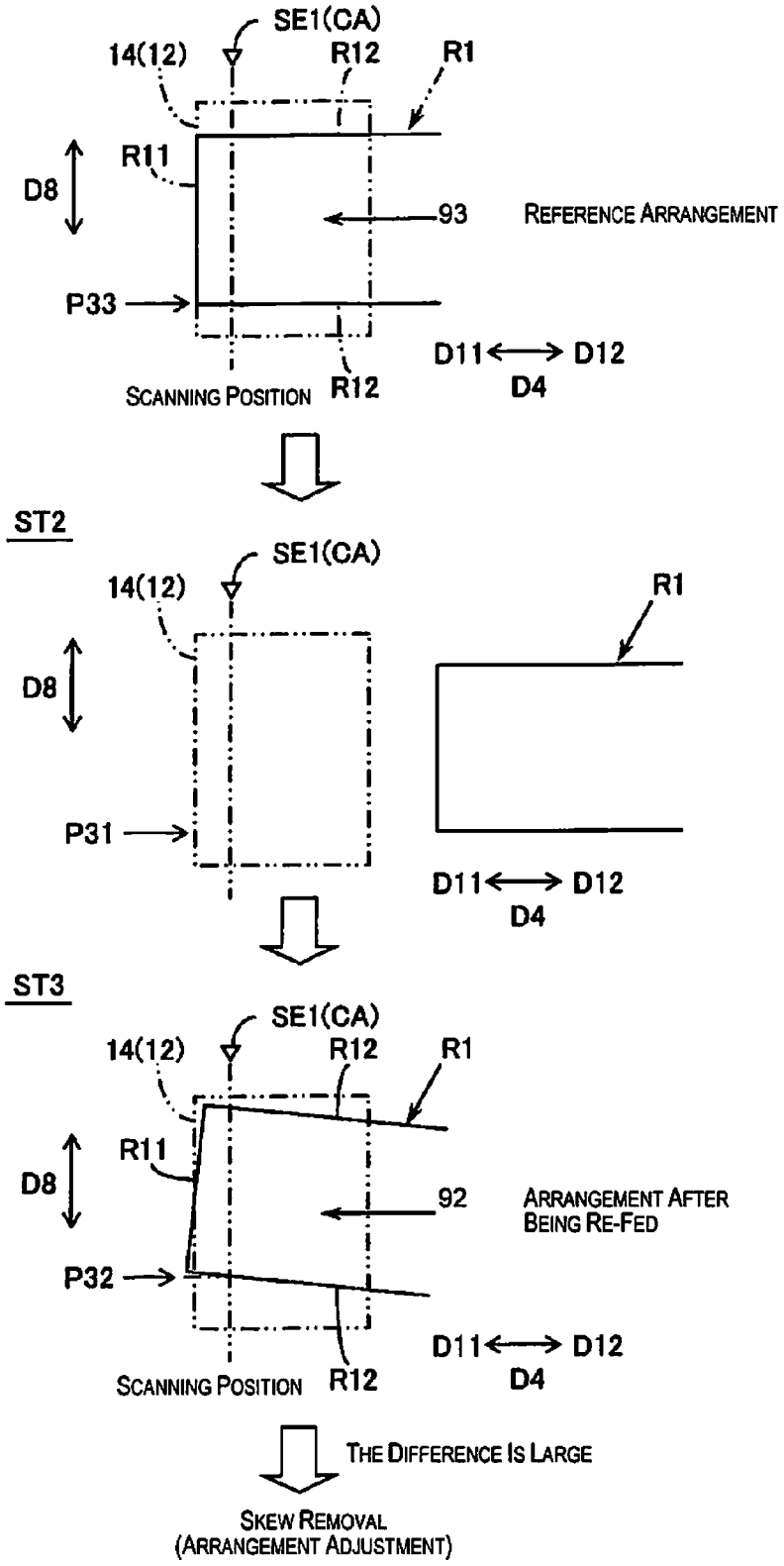
FIG. 12 is a view schematically explaining an example in which an arrangement adjustment of the recording medium is performed.

Explaining with reference to FIGS. 11 and 12, the reference arrangement state is a state of the reference arrangement 93 to be compared with the arrangement 92 of the recording medium R1 after being re-fed, and, for example, is a reference position P33 of the edge portion R12 of the recording medium in the main scanning direction D8. In this case, the storage section U4 stores the reference position P33 to be compared with the position P32 of the recording medium R1 after being re-fed as a reference arrangement 93. Of course, the reference arrangement state can be, a reference position of both end portions of the front end portion R11 of the recording medium in the feeding direction D4, the reference posture of the front end portion R11, the reference posture of the edge portion R12, etc.

ST3 shown in FIG. 11 illustrates an example in which the difference between the arrangement 92 after being re-fed and the reference arrangement 93 is small. This example shows the case in which the difference between the position P32 of the edge portion R12 of the recording medium R1 after being re-fed in the main scanning direction D8 and the reference position P33 of the edge portion R12 in the main scanning direction D8 is smaller than the predetermined amount.

In this recording device 1, when the difference between both the arrangements 92 and 93 is less than the predetermined amount, print processing can be executed promptly without performing the processing for adjusting the arrangement 92 after being re-fed such as a skew correction.

Next, the recording medium switching processing to be performed in the recording device 1 will be exemplified using FIG. 8. Here, since the reference arrangement state is stored in the storage section U4, the processing of S100 will not be performed.

At the feeding side of the recording medium R1, after the sensor SE2 in the common path 11 detects that no recording medium exists, the recording medium is hold for a predetermined period of time (S108), the recording medium R1 is sent out from the standby position (S110), the recording medium R1 is gripped with the rollers 27 and 28 in the common conveyance section 26 (S112), and when the arrangement state of the recording medium R1 in the recording section 12 is detected (S114), it is judged whether or not it is necessary to execute the processing for adjusting the arrangement of the recording medium R1 (S116). For example, when the difference between the position P32 (arrangement 92) before being re-fed and the position P33 (arrangement 93) of the reference position P33 is equal to or more than a predetermined amount ΔP, the processing is terminated after performing the arrangement adjustment processing (S118), while when the difference between the positions P32 and P33 is less than the predetermined amount ΔP, the processing is terminated as it is.

As explained above, it is selected whether or not the arrangement of the arrangement of the recording medium R1 is to be adjusted based on the arrangement state of the recording medium R1 after being re-fed and the reference arrangement state, and therefore it is possible for the recording device 1 to shorten the time from re-feeding of the recording medium R1 to the execution of recording. Further, when the difference between the arrangement 92 of the recording medium after being re-fed and the reference arrangement 93 of the recording medium is as large as the predetermined amount ΔP or more, processing for adjusting the arrangement 92 of the recording medium after being re-fed is performed. On the other hand, when the difference between the arrangements 92 and 93 is as small as less than the predetermined amount ΔP, the processing for adjusting the arrangement 92 of the recording medium after being re-fed is not performed. Therefore, in the recording device 1, it is possible to shorten the time from re-feeding of the recording medium R1 to the execution of recording.

Further, in the present invention, various modified embodiments can be considered.

For example, the recording medium to which the present invention can be applied can be, other than the rolled paper, a folded continuous paper, a cut sheet, etc.

The drive roller and the driven roller constituting the aforementioned pair of rollers can be arranged in a manner opposite to the aforementioned positional relation. Further, the pair of rollers can be constituted by a pair of drive roller using driving rollers in place of the driven rollers.

The recording device can be a device that performs recording by switching three or more recording media.

Further, the present invention can also be applied to a conveyance device for conveying a conveyance medium.

In the aforementioned embodiment, although the recording medium before being pulled-back is fed to the recording section 12, the recording medium before being pulled-back can be fed to an upstream side position such as the common conveyance section 26 before reaching the recording section 12. Also in this case, the present invention can be applied.

In S204 of the arrangement adjusting processing shown in FIG. 10, other than sucking the recording medium to the platen 14, processing such as, e.g., gripping (holding) the recording medium with rollers 27 and 28 of the common conveyance section 26 can be performed. In this case, the processing of S210 can be omitted.

In order to perform skew correction, the processing can be performed in which, after rewinding the recording medium to the feeding direction upstream side than the common conveyance section 26, the recording medium is fed so that the front end portion of the recording medium is brought into contact with the rollers 27 and 28, which are arranged closely.

As explained above, according to the present invention, by various embodiments, it is possible to provide technique, etc., capable of shortening the time from re-feeding of the recording medium to the execution of recording. Of course, even if the technique, etc., constituted only by the structural elements (including embodiments described in embodiments) of an independent claim that does not have the structural elements of dependent claims, the aforementioned fundamental functions and effects can be obtained.

Further, a structure in which each structure disclosed in the aforementioned embodiments and modified embodiments are mutually replaced, combined, or changed, a structure in which known techniques, each structure disclosed in the aforementioned embodiments and modified embodiments are mutually replaced, combined or changed, etc., can also be put into practice. The present invention includes these structures, etc.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a recording section configured to perform recording on a first recording medium and a second recording medium, and move in a scanning direction perpendicular to a feeding direction of the first recording medium and the second recording medium;

a first medium supporting section configured to be in a state of feeding and pulling back the first recording medium and support the first recording medium;

a detecting portion mounted on the recording section so as to move together with the recording section in the scanning direction and configured to detect a first arrangement state of the first recording medium after being fed from the first medium supporting section and before being pulled back, and a second arrangement state of the first recording medium after being pulled back and then fed from the first medium supporting section, the detecting portion being configured to detect a position of an edge portion of the first recording medium in the scanning direction to detect the first arrangement state and the second arrangement state while moving in the scanning direction;

an adjusting section configured to select whether or not to process for adjusting an arrangement of the first recording medium based on the first arrangement state and the second arrangement state;

a second medium supporting section configured to be in a state of feeding and pulling back the second recording medium and support the second recording medium; and a common path of the first recording medium and the second recording medium, the common path extending through the recording section from the first and second medium supporting sections, after an operation of pulling back the first recording medium fed from the first medium supporting section is initiated and while a front end portion in the feeding direction of the first recording medium remains in the common path, an operation of feeding the second recording medium being initiated.

2. The recording device according to claim 1, wherein the adjusting section performs a processing for adjusting the arrangement of the first recording medium when a difference between the first arrangement state and the second arrangement state is equal to or more than a predetermined amount.

3. The recording device according to claim 1, further comprising a conveyance section configured to convey the first recording medium fed from the first medium supporting section, wherein when the first recording medium is pulled back by driving the first medium supporting section, the conveyance section is driven so as to convey the first recording medium toward the first medium supporting section.

4. The recording device according to claim 1, further comprising:

a medium path through which the second recording medium from the second medium supporting section passes to the common path; and a detector configured to detect presence or absence of the second recording medium at a predetermined position in the medium path, wherein when the first recording medium is being fed from the first medium supporting section into the common path, the second recording medium is fed and the second recording medium is stopped at a standby position located on a side of the common path than the detector in the medium path, and when the first recording medium fed in the common path is pulled back, the second recording medium stopped at the standby position is fed into the common path.

5. The recording device according to claim 1, further comprising:

a holding and conveying section configured to releasably grip the first recording medium fed from the first medium supporting section; and a holding portion configured to hold the first recording medium at a holding position on a downstream side respective to the holding and conveying section in the feeding direction, wherein the adjusting section performs, as processing for adjusting the arrangement of the first recording medium, a control of releasing the holding and conveying section from gripping the first recording medium, holding the first recording medium fed to the holding position by the holding portion, adding a force to the first recording medium in a pulling back direction from the first medium supporting section, holding the first recording medium by the holding and conveying section, and releasing the holding portion from gripping the first recording medium.

6. The recording device according to claim 1, wherein the detecting portion detects a first position of the edge portion of the first recording medium before being pulled back along the feeding direction as the first arrangement state, and detects a second position of the edge portion of the first recording medium after being re-fed along the feeding direction as the second arrangement state, and the adjusting section performs a processing of adjusting the arrangement of the first recording medium when a difference between the first position before being pulled back and the second position after being re-fed is equal to or more than a predetermined amount.

7. The recording device according to claim 1, wherein the detecting portion is configured to detect the second arrangement state after the first recording medium has been pulled back to a standby position, held at the standby position for a predetermined period, and then fed from the standby position in the feeding direction by the first medium supporting section, and the standby position is a position where the front end portion of the first recording medium is located upstream relative to the recording section in the feeding direction and downstream relative to the first medium supporting section.

8. The recording device according to claim 1, wherein the detecting portion is configured to further detect at least one of a position of the front end portion of the first recording medium, an angle of the front end portion relative to the perpendicular direction, and an angle of the edge portion of the first recording medium in the perpendicular direction relative to the feeding direction to detect the first arrangement state and the second arrangement state.

9. A recording device comprising:

a recording section configured to perform recording on a first recording medium and a second recording medium, and move in a scanning direction perpendicular to a feeding direction of the first recording medium and the second recording medium;

a first medium supporting section configured to be in a state of feeding and pulling back the first recording medium and support the first recording medium;

a detecting portion mounted on the recording section so as to move together with the recording section in the scanning direction and configured to detect an arrangement state of the first recording medium that has been re-fed after the first recording medium has been fed from the first medium supporting section and pulled back toward the first medium supporting section, the detecting portion being configured to detect a position of an edge portion of the first recording medium in the scanning direction to detect the arrangement state while moving in the scanning direction;

a storage section configured to store a reference arrangement state to be compared with the arrangement state after being re-fed;

an adjusting section configured to select whether or not to process for adjusting an arrangement of the first recording medium based on the arrangement state after being re-fed and the reference arrangement state;

a second medium supporting section configured to be in a state of feeding and pulling back the second recording medium and support the second recording medium; and a common path of the first recording medium and the second recording medium, the common path extending through the recording section from the first and second medium supporting sections, after an operation of pulling back the first recording medium fed from the first medium supporting section is initiated and while a front end portion in the feeding direction of the first recording medium remains in the common path, an operation of feeding the second recording medium being initiated.

10. A conveyance device comprising:

a first medium supporting section configured to be in a state of feeding and pulling back a first conveyance medium and support the first conveyance medium;

a detecting portion configured to move in a perpendicular direction perpendicular to a feeding direction of the first conveyance medium and detect a first arrangement state of the first conveyance medium after being fed from the first medium supporting section and before being pulled back, and a second arrangement state of the first conveyance medium after being pulled back and fed from the first medium supporting section, the detecting portion being configured to detect a position of an edge portion of the first conveyance medium in the perpendicular direction to detect the first arrangement state and the second arrangement state while moving in the perpendicular direction;

an adjusting section configured to select whether or not to process for adjusting an arrangement of the first conveyance medium based on the first arrangement state and the second arrangement state;

a second medium supporting section configured to be in a state of feeding and pulling back a second conveyance medium and support the second conveyance medium; and a common path of the first conveyance medium and the second conveyance medium, the common path being disposed downstream in the feeding direction relative to the first and second medium supporting sections, after an operation of pulling back the first conveyance medium fed from the first medium supporting section is initiated and while a front end portion in the feeding direction of the first conveyance medium remains in the common path, an operation of feeding the second conveyance medium being initiated.

11. A conveyance device comprising:

a first medium supporting section configured to be in a state of feeding and pulling back a first conveyance medium and support the first conveyance medium;

a detecting portion configured to move in a perpendicular direction perpendicular to a feeding direction of the first conveyance medium and detect an arrangement state of the first conveyance medium that has been re-fed after the first conveyance medium has been fed from the first medium supporting section and pulled back toward the first medium supporting section, the detecting portion being configured to detect a position of an edge portion of the first conveyance medium in the perpendicular direction to detect the arrangement state while moving in the perpendicular direction;

a storage section configured to store a reference arrangement state to be compared with the arrangement state after being re-fed;

an adjusting section configured to select whether or not to process for adjusting an arrangement of the first conveyance medium based on the arrangement state after being re-fed and the reference arrangement state;

a second medium supporting section configured to be in a state of feeding and pulling back a second conveyance medium and support the second conveyance medium; and a common path of the first conveyance medium and the second conveyance medium, the common path being disposed downstream in the feeding direction relative to the first and second medium supporting sections, after an operation of pulling back the first conveyance medium fed from the first medium supporting section is initiated, and while a front end portion in the feeding direction of the first conveyance medium remains in the common path, an operation of feeding the second conveyance medium being initiated.

12. A conveyance method for conveying a first conveyance medium and a second conveyance medium, the conveyance method comprising:

detecting, by a detecting portion, a first arrangement state of the first conveyance medium fed from a first medium supporting section that is configured to be in a state of feeding and pulling back and support the first conveyance medium by detecting a first position of an edge portion of the first conveyance medium in a perpendicular direction perpendicular to a feeding direction of the first conveyance medium while moving the detecting portion in the perpendicular direction;

pulling back the first conveyance medium which has been fed toward the first medium supporting section;

re-feeding from the first medium supporting section the first conveyance medium which has been pulled back;

detecting, by the detecting portion, a second arrangement state of the first conveyance medium which has been re-fed by detecting a second position of the edge portion of the first conveyance medium in the perpendicular direction while moving the detecting portion in the perpendicular direction;

selecting whether or not an arrangement of the first conveyance medium is to be adjusted based on the first arrangement state and the second arrangement state; and initiating an operation of feeding a second conveyance medium from a second medium supporting section configured to be in a state of feeding and pulling back the second conveyance medium and support the second conveyance medium, after initiating an operation of pulling back the first conveyance medium fed from the first medium supporting section and while a front end portion in the feeding direction of the first conveyance medium remains in a common path of the first conveyance medium and the second conveyance medium, the common path being disposed downstream in the feeding direction relative to the first and second medium supporting sections.

13. A conveyance method for conveying a first conveyance medium and a second conveyance medium, the conveyance method comprising:

re-feeding from a first medium supporting section the first conveyance medium that has been fed from the first medium supporting section and pulled back toward the first medium supporting section, the first medium supporting section being configured to be in a state of feeding and pulling back the first conveyance medium and support the first conveyance medium to be conveyed;

detecting, by a detecting portion, an arrangement state of the first conveyance medium which has been re-fed by detecting a position of an edge portion of the first conveyance medium in a perpendicular direction perpendicular to a feeding direction of the first conveyance medium while moving the detecting portion in the perpendicular direction; and selecting whether or not an arrangement of the first conveyance medium is to be adjusted based on the arrangement state after re-feeding and a reference arrangement state to be compared with the arrangement state; and initiating an operation of feeding a second conveyance medium from a second medium supporting section configured to be in a state of feeding and pulling back the second conveyance medium and support the second conveyance medium, after initiating an operation of pulling back the first conveyance medium fed from the first medium supporting section and while a front end portion in the feeding direction of the first conveyance medium remains in a common path of the first conveyance medium and the second conveyance medium, the common path being disposed downstream in the feeding direction relative to the first and second medium supporting sections.

* * * * *